US007828285B2

(12) United States Patent
Chu et al.

(10) Patent No.: US 7,828,285 B2
(45) Date of Patent: Nov. 9, 2010

(54) SHEET MEDIA INPUT SYSTEM

(75) Inventors: Tzy Woei Chu, The Comtech (SG); Tung Wen Tu, Taipei (TW)

(73) Assignee: Hewlett-Packard Development Company, L.P., Houston, TX (US)

( * ) Notice: Subject to any disclaimer, the term of this patent is extended or adjusted under 35 U.S.C. 154(b) by 400 days.

(21) Appl. No.: 11/659,070

(22) PCT Filed: Mar. 1, 2005

(86) PCT No.: PCT/SG2005/000064

§ 371 (c)(1),
(2), (4) Date: Jan. 31, 2007

(87) PCT Pub. No.: WO2006/093465

PCT Pub. Date: Sep. 8, 2006

(65) Prior Publication Data

US 2007/0273084 A1 Nov. 29, 2007

(51) Int. Cl.
*B65H 3/34* (2006.01)

(52) U.S. Cl. ..... 271/167; 271/169

(58) Field of Classification Search ..... 271/169, 271/167

See application file for complete search history.

(56) References Cited

U.S. PATENT DOCUMENTS 3,403,903 A * 10/1968 Caril ..... 271/20
3,601,394 A * 8/1971 Lang et al. ..... 271/169
5,611,526 A 3/1997 Cornell et al.
6,085,065 A * 7/2000 Ando ..... 399/402
6,209,999 B1 4/2001 Wen et al.
6,382,621 B1 * 5/2002 Inoue et al. ..... 271/120
6,409,165 B1 * 6/2002 Yamaoka et al. ..... 271/145
6,422,772 B1 7/2002 Fisher, Sr. et al.
6,893,013 B2 * 5/2005 Spitz et al. ..... 271/104
7,128,317 B2 * 10/2006 Johnson et al. ..... 271/121
2004/0251592 A1 * 12/2004 Ruhe et al. ..... 271/109
2006/0038339 A1 * 2/2006 Shimamura ..... 271/121

FOREIGN PATENT DOCUMENTS

DE 102005024249 A1 * 11/2006
JP 04164723 A * 6/1992
JP 04280747 A * 10/1992
JP 09086726 A * 3/1997

* cited by examiner

*Primary Examiner*—Saúl J Rodríguez
*Assistant Examiner*—Howard Sanders

(57) ABSTRACT

The present invention provides a removable input tray to be used in an image forming device, such as a printer. The input tray includes a front wall with a sloped surface for sheet separation, an opening in the front wall, and a retractor pivotally mounted in the opening. The retractor is movable between a stopping position and a retracted position, the stopping position provides a stop to the leading edge of a stack of media sheets when the stack is being inserted into the input tray, and the retracted position is triggered when the input tray is fully inserted into the image forming device.

10 Claims, 5 Drawing Sheets

SHEET MEDIA INPUT SYSTEM

FIELD OF THE INVENTION

The present invention generally relates to sheet media input systems for printers and other sheet media processing devices.

BACKGROUND

In many image forming devices such as inkjet printers, scanners, copiers and fax machines, pick mechanisms are provided to pick individual sheets of print media, e.g. paper, from the top of a stack of media sheets that is held in an input tray. Some printers are designed with a removable input tray, thereby allowing the user to gain full access to the tray to load a stack of media sheets. In one conventional input tray design, the input tray contains a ramp with sloped surface at the front end to enable sheet separation during media feeding. However, with this design, the user has often encountered problem aligning the leading edge of the media stack to the front end of the input tray because the sloped surface does not provide a clear indication of a stopping position. Proper positioning of the stack of sheets in the input tray is essential to subsequent performance of the pick mechanism. If the media stack is improperly positioned in the input tray by the user, media feeding failure can result. Improper feeding can cause media jams, skew of the media sheet being fed, or picking of multiple sheets from the input tray.

There exists a need for a removable input tray with an alignment mechanism for proper positioning of a stack of media sheets that is reliable, low cost and easy to implement.

SUMMARY

The present invention provides a removable input tray to be used in an image forming device, such as a printer. The input tray includes a front wall with a sloped surface for sheet separation, an opening in the front wall, and a retractor pivotally mounted in the opening. The retractor is movable between a stopping position and a retracted position, the stopping position provides a stop to the leading edge of a stack of media sheets when the stack is being inserted into the input tray, and the retracted position is triggered when the input tray is fully inserted into the image forming device.

The objects, features and advantages of the present disclosure will become apparent from the detailed description when read in conjunction with the drawings.

DETAILED DESCRIPTION

Figure 1:
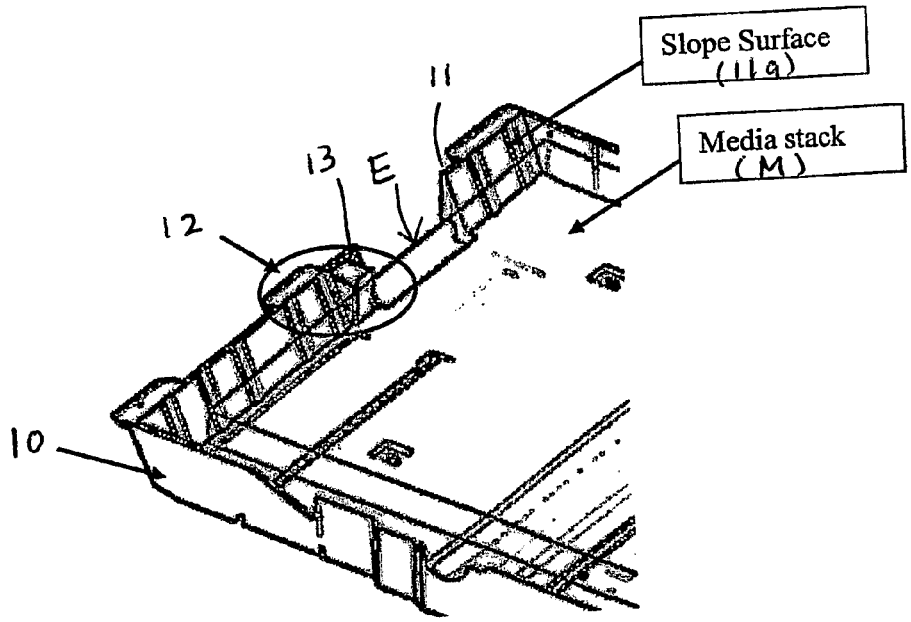
FIG. 1 shows a removable input tray with a retractor for proper alignment of a stack of media sheets according to one embodiment of the present invention

FIG. 1 shows a removable input tray 10 for holding a stack of media sheets M according to one embodiment of the present invention. It should be understood that this input tray may be implemented in any printer or image forming device that requires processing of media sheets from a stack of media sheets. The removable input tray 10 has a front wall 11 with a sloped surface ha and a retractor 12 rotatably mounted in an opening 13 in the front wall. The retractor 12 functions as a stop for the leading edge E of the media stack M when the media stack is being loaded into the input tray by the user, thereby providing a clear feedback to the user regarding the proper alignment of the media stack.

Figure 2:
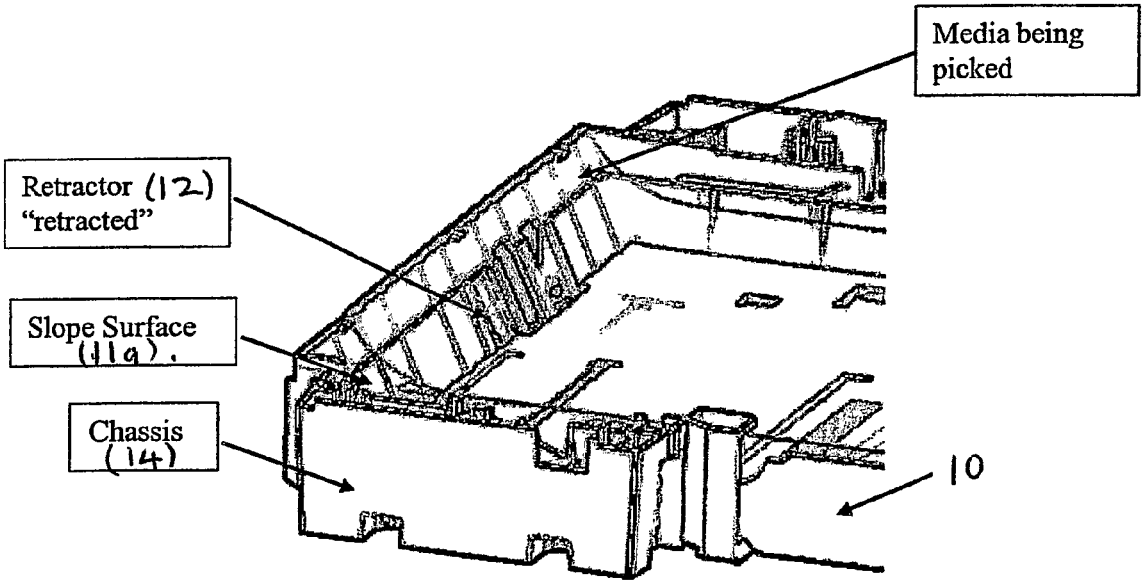
FIG. 2 shows the retractor in the retracted position when the input tray is fully inserted in a chassis.

Referring to FIG. 2, the in put tray 10 is configured so that it can removably engage with a chassis 14 of an image forming device, whereby permitting the input tray to be received in and withdrawn from the chassis. The chassis 14 is a component of the image forming device is configured to receive the input tray 10. The retractor 12 is movable between a stopping position shown in FIG. 1 and a retracted position shown in FIG. 2. The retractor 12 is configured to retract when the input tray 10 is inserted into the chassis 14. FIG. 2 also shows a media sheet being picked from the input tray 10 by a conventional pick mechanism (not shown) and fed into the processing section of the image forming device. In the retracted position, the retractor 12 falls back into the opening 13 in the sloped surface 11*a* of the input tray 10 so as not to interfere with the sheet separation and picking operation. The chassis 14 is also provided with a sloped surface 15 that corresponds with the sloped surface ha of the input tray 10 to provide an angular surface against which individual media sheets climb for separation as the sheets are being removed from the input tray 10.

Figure 3:
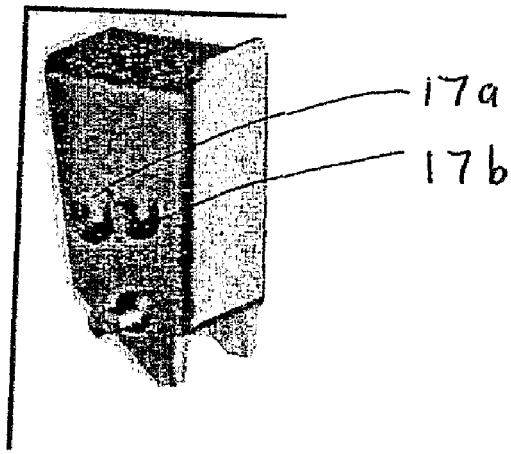
FIG. 3 is close-up view of the retractor.
Figure 4A:
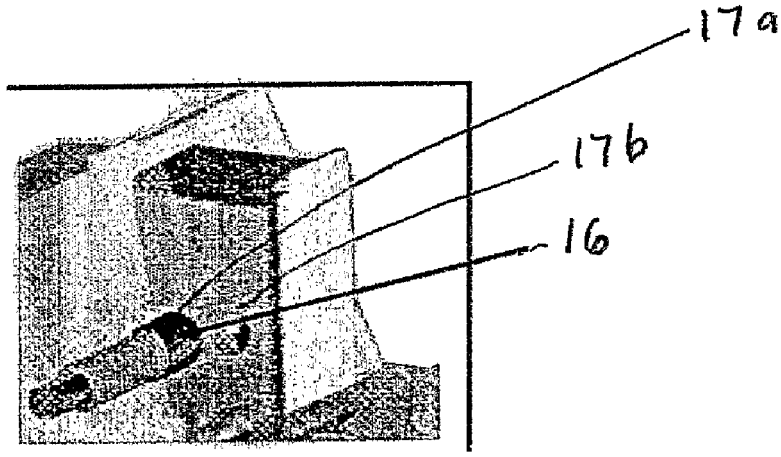
FIG. 4A shows a spring-loaded cam holding the retractor in the stopping position.
Figure 4B:
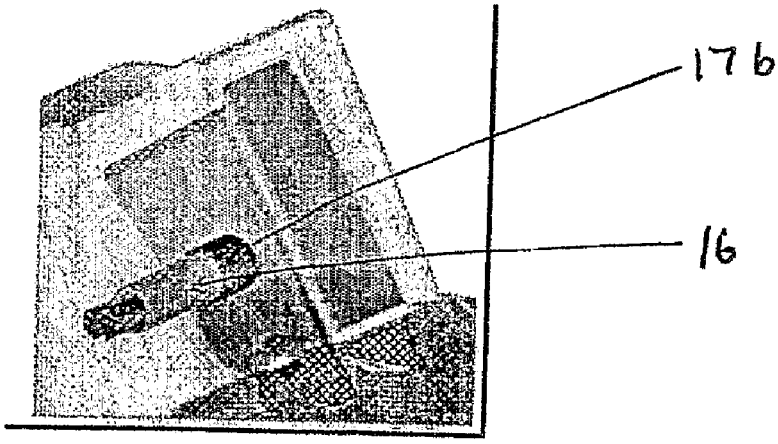
FIG. 4B shows the spring-loaded cam holding the retractor in the retracted position.

FIG. 3 shows a closed up view of the retractor 12. The retractor provided with two recesses 17*a* and 17*b* on one side surface to control the toggle position of the retractor 12. Referring to FIG. 4A, a spring-loaded cam 16 is mounted in the input tray 10 so as to hold the retractor in either the stopping position or the retracted position by engaging either recess 17*a* or recess 17*b*. FIG. 4A shows the spring-loaded cam 16 engaging recess 17*a* to hold the retractor 12 in the vertical stopping position. FIG. 4B shows spring-loaded cam 16 engaging recess 17*b* to hold the retractor 12 in the retracted position. It is advantageous to position the retractor 12 about the center of the width of the input tray.

Figure 5:
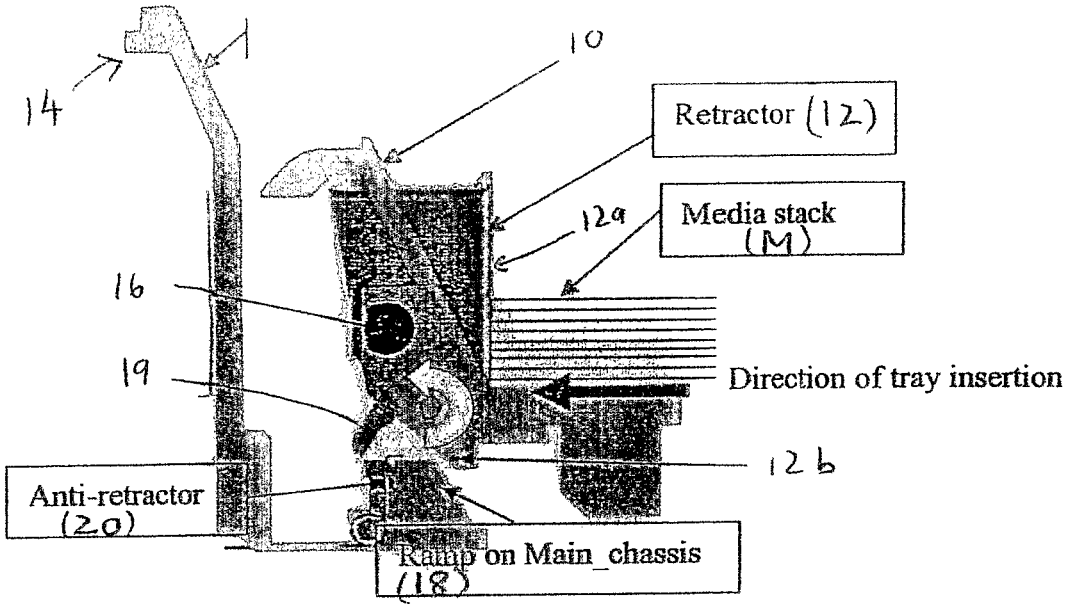
FIG. 5 is a cross-section view showing the input being inserted in the chassis.

FIG. 5 shows a cross-section view of the input tray 10 and the chassis 14 as the input tray is being inserted into the chassis. Referring to FIG. 5, the chassis 14 has a ramp 18 at the bottom of the chassis 14. An anti-retracting structure 20 is coupled to the ramp 18. The retractor 12 has a stopping surface 12*a* that extends substantially perpendicular relative to the bottom of the input tray 10 when the retractor is in the stopping position. The retractor 12 also has a retractor arm 19 extending from a bottom surface 12*b*. The spring-loaded cam 16 is shown to hold the retractor 2 in the stopping position. As the input tray 10 is being inserted, the retractor 12 hits the ramp 18 then rotates backwards in the counterclockwise direction. In other words, the retracted position of the retractor 12 is triggered by the insertion of the input tray into the chassis 14.

Figure 6:
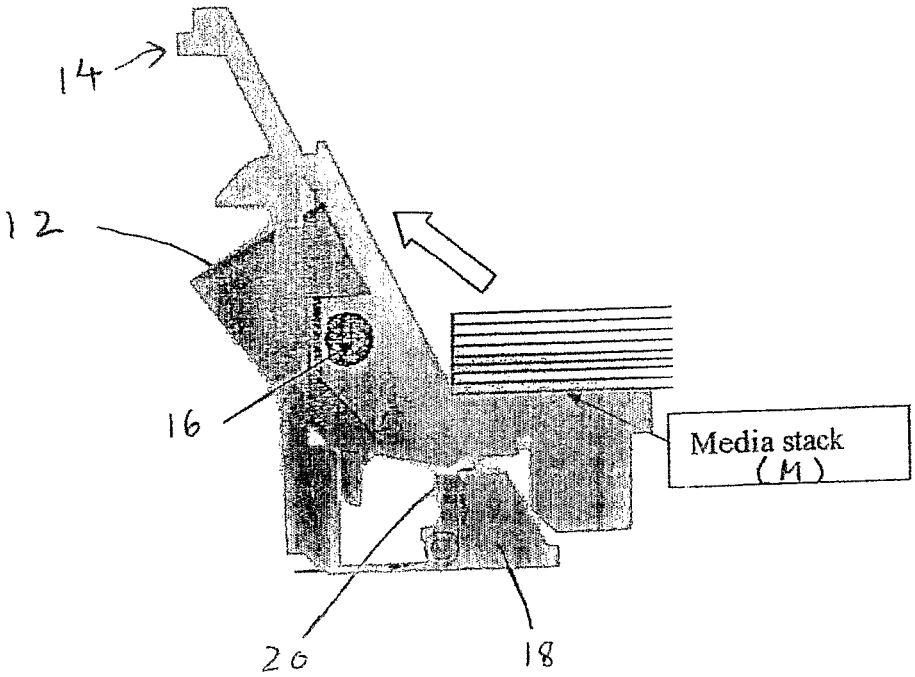
FIG. 6 is a cross-section view showing the input tray fully inserted in the chassis.

FIG. 6 shows the input tray 10 fully inserted in the chassis 14 and the retractor 12 is in the retracted position. The spring-loaded cam 16 is shown to hold the retracted position of the retractor 12. The chassis 14 has a front wall h4*a* with an opening for receiving the retractor 12 in the retracted position.

Figure 7:
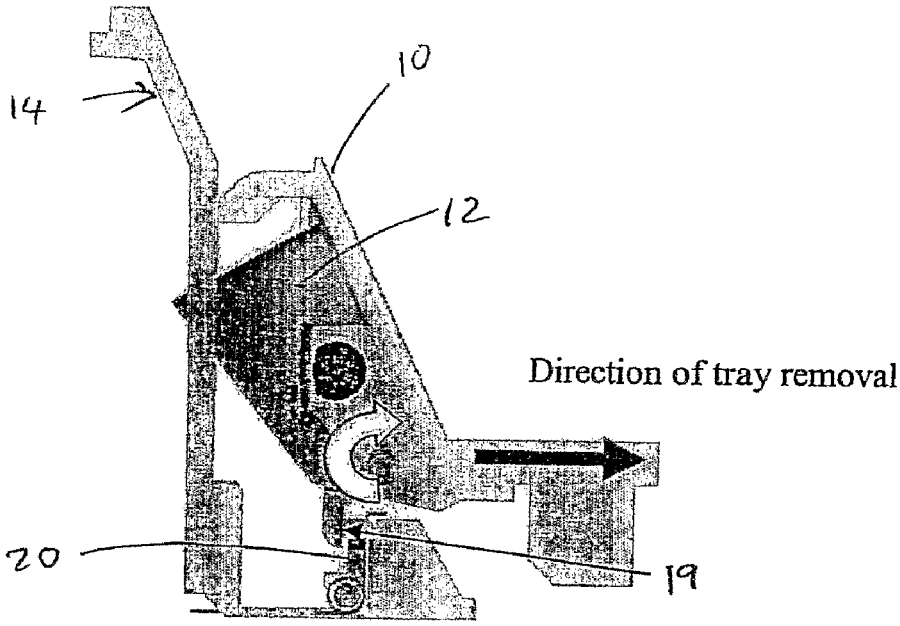
FIG. 7 is a cross-section view showing the input tray being pulled out of the chassis.

FIG. 7 illustrates the removal of the input tray 10. When the input tray is being pulled out of the chassis 14, the retractor arm 19 hits the anti-retracting structure 20 thereby causing the retractor 12 to rotate clockwise and return to the stopping position.

Figure 8:
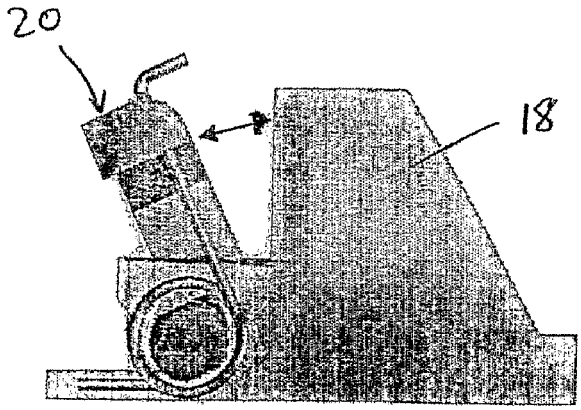
FIG. 8 is a close-up view of an anti-retracting structure.
Figure 9:
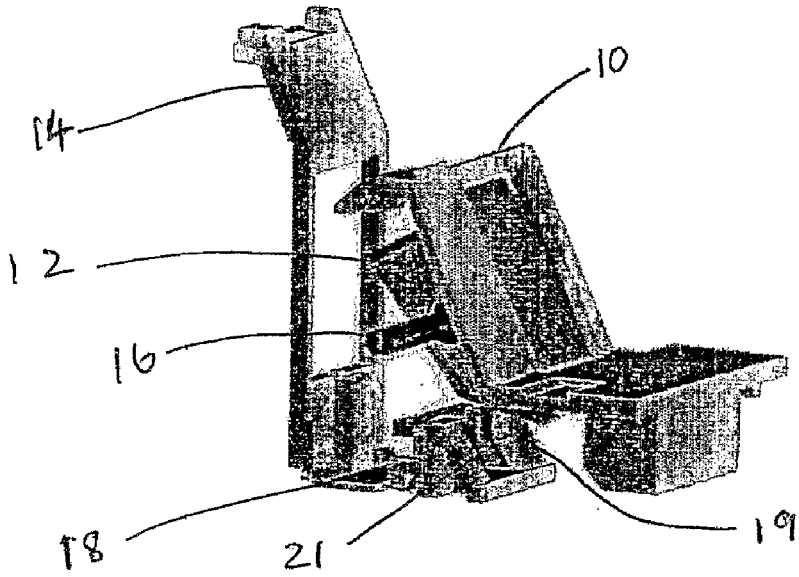
FIG. 9 illustrates a misuse situation in which the retractor is in the retracted position as the input tray is being inserted into the chassis.
Figure 10:
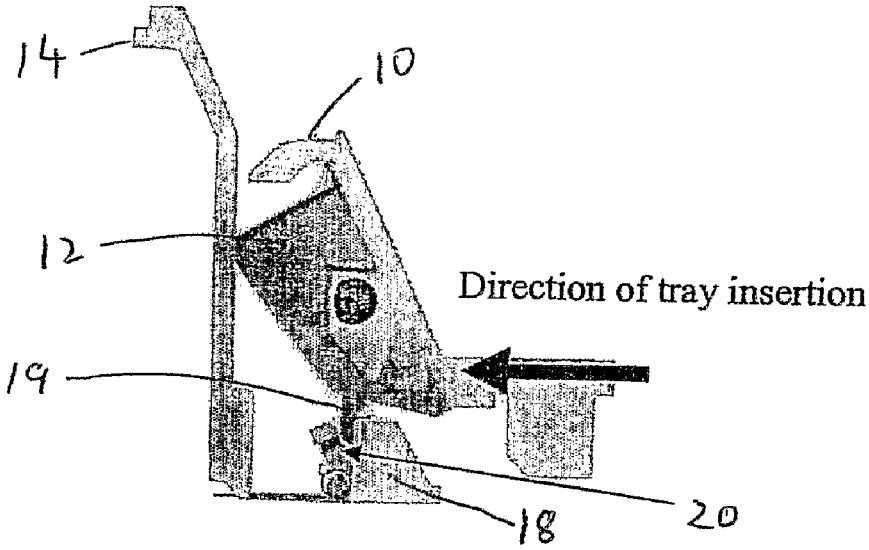
FIG. 10 illustrates the function of the anti-retracting structure during the misuse situation.

Referring to FIG. 8, the anti-retracting structure 20 is spring-loaded and pivotally mounted such that it can be rotated in counter-clockwise direction. The anti-retracting structure 20 is designed so that it will give way to the retractor 12 when the retractor is in the retracted position, instead of the stopping position, as the input tray 10 is being inserted Into the chassis 14 as shown in FIG. 9. This situation could occur as a result of misuse by the user. In this situation, the retractor arm 19 pushes the anti-retracting structure 20 backwards as the input tray is being inserted (FIG. 10). As can be seen from FIG. 8, the ramp 18 has a slot opening 21 to allow the passage of the retractor arm 19. In this way, the retractor 12 remains in the retracted position until the input tray is fully inserted. The anti-retracting structure 20 then springs back to its default position when the input tray is fully inserted. If the anti-retracting structure 20 is rigidly mounted, the retractor arm 20 would break off in the misuse situation.

It is intended that that the embodiment contained in the above description and shown in the accompanying drawings is illustrative and not limiting. It will be clear to those skilled in the art that modifications may be made to the embodiment without departing from the scope the invention as defined by the appended claims.

What is claimed is:

1. A removable input tray to be used in an image forming device, said input tray comprising:

a front wall with a sloped surface for sheet separation, said sloped surface extending along a plane;

an opening in the front wall formed along the sloped surface; and a retractor rotatably mounted in the opening, said retractor having a front surface for stopping a leading edge of a stack of media sheets and a retractor arm extending from a bottom surface of the retractor, wherein the retractor is movable between a stopping position and a retracted position, the stopping position is triggered when the input tray is removed from the image forming device and provides a stop to the leading edge of a stack of media sheets being inserted into the input tray, and the retracted position is triggered when the input tray is inserted into the image forming device through contact of the retractor arm with a portion of the input tray, wherein the front surface of the retractor extends at an angle with respect to the plane of the sloped surface of the front wall when in the stopping position and is substantially coplanar with the plane of the sloped surface of the front wall when in the retracted position.

2. The removable input tray of claim 1 further comprising a spring-loaded cam mounted adjacent to the retractor so as to hold the retractor in the stopping position or the retracted position.

3. The removable input tray of claim 2, wherein the retractor comprises two recesses in a side wall, and the spring-loaded cam engages one recess to hold the retractor in the stopping position and engages the other recess to hold the retractor in the retracted position.

4. An image forming apparatus comprising:

a removable input tray having a front wall with a sloped surface and an opening in the front wall, said sloped surface extending along a plane and said opening being formed along the sloped surface of the front wall;

a retractor rotatably mounted in the opening, the retractor having a front surface for stopping a leading edge of a stack of media sheets and being movable between a stopping position and a retracted position, and wherein the front surface of the retractor extends at an angle with respect to the plane of the sloped surface of the front wall when in the stopping position and is substantially coplanar with the plane of the sloped surface of the front wall when in the retracted position; and a chassis configured to receive the input tray, wherein the stopping position is triggered when the removable input tray is removed from the chassis and provides a stop to the leading edge of a stack of media sheets being inserted into the input tray, and the retracted position is triggered when the input tray is fully inserted into the chassis.

5. The image forming apparatus of claim 4 further comprising:

an anti-retracting structure mounted on the chassis for triggering the retractor to return to the stopping position when the input tray is being removed from the chassis.

6. The image forming apparatus of claim 5, wherein the retractor comprises a retractor arm extending from a bottom surface, the retractor arm being configured to hit the anti-retracting structure when the input tray is being removed from the chassis, thereby causing the retractor to rotate clockwise from the retracted position to the stopping position.

7. The image forming apparatus of claim 5, wherein the anti-retracting structure is spring-loaded and is operable to give way to the retractor when the retractor is in the retracted position while the input tray is being inserted into the chassis.

8. The image forming apparatus of claim 4, wherein the chassis comprises an opening for receiving the retractor when the retractor is in the retracted position.

9. The image forming apparatus of claim 4, wherein the chassis comprises a ramp on a bottom surface, the ramp being configured to contact the retractor when the input tray is being inserted into the chassis, thereby causing the retractor to rotate counterclockwise from the stopping position to the retracted position.

10. The image forming apparatus of claim 9 further comprising an anti-retracting structure coupled to the ramp for triggering the retractor to return to the stopping position when the input tray is being removed from the chassis.

* * * * *